US009215936B1

(12) United States Patent
Hoffmann et al.

(10) Patent No.: US 9,215,936 B1
(45) Date of Patent: Dec. 22, 2015

(54) PERSONAL POOL

(71) Applicants: Dianne Hoffmann, Maple Glen, PA (US); Mark D. Kuhn, IV, Yardley, PA (US); Luc Tenthorey, Durham, CT (US); John Halko, IV, New Hope, PA (US)

(72) Inventors: Dianne Hoffmann, Maple Glen, PA (US); Mark D. Kuhn, IV, Yardley, PA (US); Luc Tenthorey, Durham, CT (US); John Halko, IV, New Hope, PA (US)

(73) Assignee: Dianne Hoffmann, Maple Glen, PA (US)

( * ) Notice: Subject to any disclaimer, the term of this patent is extended or adjusted under 35 U.S.C. 154(b) by 0 days.

(21) Appl. No.: 14/814,535

(22) Filed: Jul. 31, 2015

(51) Int. Cl.
*A47C 7/62* (2006.01)
*A47C 7/68* (2006.01)

(52) U.S. Cl.
CPC ..... *A47C 7/68* (2013.01)

(58) Field of Classification Search
CPC ..... A47C 7/68; A47C 7/72; A47C 7/74
USPC ..... 297/180.15, 135, 145, 161, 162, 393, 297/394, 397; 4/546, 589, 579, 590
See application file for complete search history.

(56) References Cited

U.S. PATENT DOCUMENTS 2,724,123 A * 11/1955 Kesler ..... E04H 4/0056 135/96
3,267,887 A * 8/1966 Boyd ..... A47C 7/68 108/152
3,586,368 A * 6/1971 Guild ..... A47C 7/68 297/135
3,731,956 A * 5/1973 Hanley ..... B65D 9/12 217/13
3,910,634 A * 10/1975 Morris ..... B60N 2/2806 297/250.1
3,969,776 A * 7/1976 Gildea ..... A47K 3/02 4/546
4,003,598 A * 1/1977 Glaze ..... A47C 7/70 297/161
4,230,364 A 10/1980 Parker
4,236,259 A * 12/1980 Wendt ..... E04H 4/08 4/498
4,521,926 A * 6/1985 Kuether ..... A47K 3/022 4/579
4,561,135 A * 12/1985 Adriaansen ..... A47K 3/024 4/572.1
4,619,483 A * 10/1986 Dickey ..... A47C 7/383 297/394
4,668,010 A * 5/1987 Fujiwara ..... A47C 7/70 297/150
4,734,944 A * 4/1988 O'Brien ..... A47K 3/022 4/573.1
4,738,486 A 4/1988 Surber
4,837,869 A 6/1989 Simmon
5,004,296 A 4/1991 Ziegenfuss, Jr.

(Continued)

*Primary Examiner* — Laurie Cranmer
(74) *Attorney, Agent, or Firm* — Joseph E. Maenner; Maenner & Associates, LLC

(57) ABSTRACT

A single-person chair includes a proximal end and a distal end. A generally convex central portion extends between the proximal end and the distal end. The central portion extends upwardly, forming a first pool between the proximal end and the central portion and a second pool between the distal end and the central portion. A longitudinal centerline extends between the proximal end and the distal end. A first sidewall extends between the proximal end and the distal end on a first side of the longitudinal centerline. A second sidewall extends between the proximal end and the distal end on a second side of the longitudinal centerline such that that a liquid can be contained within the chair between the proximal end, the distal end, the first sidewall, and the second sidewall.

15 Claims, 24 Drawing Sheets

(56) References Cited

U.S. PATENT DOCUMENTS

| | | | | | |
|---|---|---|---|---|---|
| D319,313 | S | * | 8/1991 | Battles | D24/204 |
| 5,207,477 | A | * | 5/1993 | Maxwell | A61G 5/10 297/188.18 |
| 5,228,148 | A | | 7/1993 | Weir | |
| 5,307,527 | A | | 5/1994 | Schober | |
| D351,740 | S | | 10/1994 | Tesmer | |
| 5,649,737 | A | * | 7/1997 | Behnke | A47C 7/70 248/221.11 |
| D404,104 | S | | 1/1999 | Scheurer et al. | |
| D407,130 | S | | 3/1999 | Scheurer et al. | |
| D407,131 | S | | 3/1999 | Scheurer et al. | |
| 5,879,377 | A | * | 3/1999 | Mullins | A61N 5/0614 5/421 |
| D416,063 | S | | 11/1999 | Scheurer et al. | |
| 6,045,423 | A | * | 4/2000 | Silvia | B63B 35/78 441/130 |
| 6,062,640 | A | * | 5/2000 | Stahl | A47C 7/70 297/135 |
| 6,139,100 | A | * | 10/2000 | Baskin-Lockman | B60N 2/2851 297/219.12 |
| 6,311,343 | B1 | | 11/2001 | Wisniewski | |
| 6,478,372 | B1 | * | 11/2002 | Lemmeyer | B60N 2/2821 297/188.18 |
| 6,637,045 | B1 | | 10/2003 | Larsen | |
| D487,988 | S | | 4/2004 | Hutton | |
| D490,995 | S | | 6/2004 | Hutton | |
| 6,783,181 | B2 | | 8/2004 | Scheurer et al. | |
| 7,025,418 | B1 | | 4/2006 | Hackal | |
| 7,182,401 | B2 | | 2/2007 | Scheurer et al. | |
| 7,571,965 | B1 | | 8/2009 | Perry | |
| 8,240,760 | B2 | | 8/2012 | Scheurer et al. | |
| 8,459,736 | B1 | | 6/2013 | Begley, Jr. | |
| 2003/0160491 | A1 | | 8/2003 | Scheurer et al. | |
| 2008/0092285 | A1 | | 4/2008 | Petersen | |
| 2010/0038938 | A1 | * | 2/2010 | Feinstein | A47C 7/744 297/180.15 |
| 2011/0099708 | A1 | | 5/2011 | Freedman | |
| 2012/0012144 | A1 | | 1/2012 | Cebular | |
| 2012/0233767 | A1 | | 9/2012 | Liu | |
| 2013/0031712 | A1 | | 2/2013 | Gossett et al. | |
| 2013/0049413 | A1 | * | 2/2013 | Devaney | A47C 7/742 297/180.15 |

* cited by examiner

PERSONAL POOL

BACKGROUND OF THE INVENTION

1. Field of the Invention

The present invention relates to a single-person pool.

2. Description of the Related Art

Meditation pools are used to help a user relax and relieve stress. Typically, meditation pools are fixed structures and are immovable. It would be beneficial to provide a portable meditation pool.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention provides a single-person chair comprising a proximal end and a distal end. A generally convex central portion extends between the proximal end and the distal end. The central portion extends upwardly, forming a first pool between the proximal end and the central portion and a second pool between the distal end and the central portion. A longitudinal centerline extends between the proximal end and the distal end. A first sidewall extends between the proximal end and the distal end on a first side of the longitudinal centerline. A second sidewall extends between the proximal end and the distal end on a second side of the longitudinal centerline such that that a liquid can be contained within the chair between the proximal end, the distal end, the first sidewall, and the second sidewall.

In an alternative embodiment, the present invention provides a single-person chair assembly comprising a chair having at least one armrest and a backrest, the backrest having a front face and a rear face. A tray is alternatively releasably connectable to the at least one armrest and storable at the rear face.

In still another alternative embodiment, the present invention provides a single-person chair assembly comprising a first concave liquid retaining portion including a backrest. A first sidewall extends from the backrest and a second sidewall extends from the backrest. A second concave liquid retaining portion includes a foot rest. The first sidewall is connected to the foot rest, and the second sidewall is connected to the foot rest. A first armrest extends outwardly from the first sidewall and a second armrest extends outwardly from the second sidewall. Each of the first armrest and the second armrest includes a tray slot formed therein. A tray is releasably insertable into one of the tray slot in the first armrest and the second armrest.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
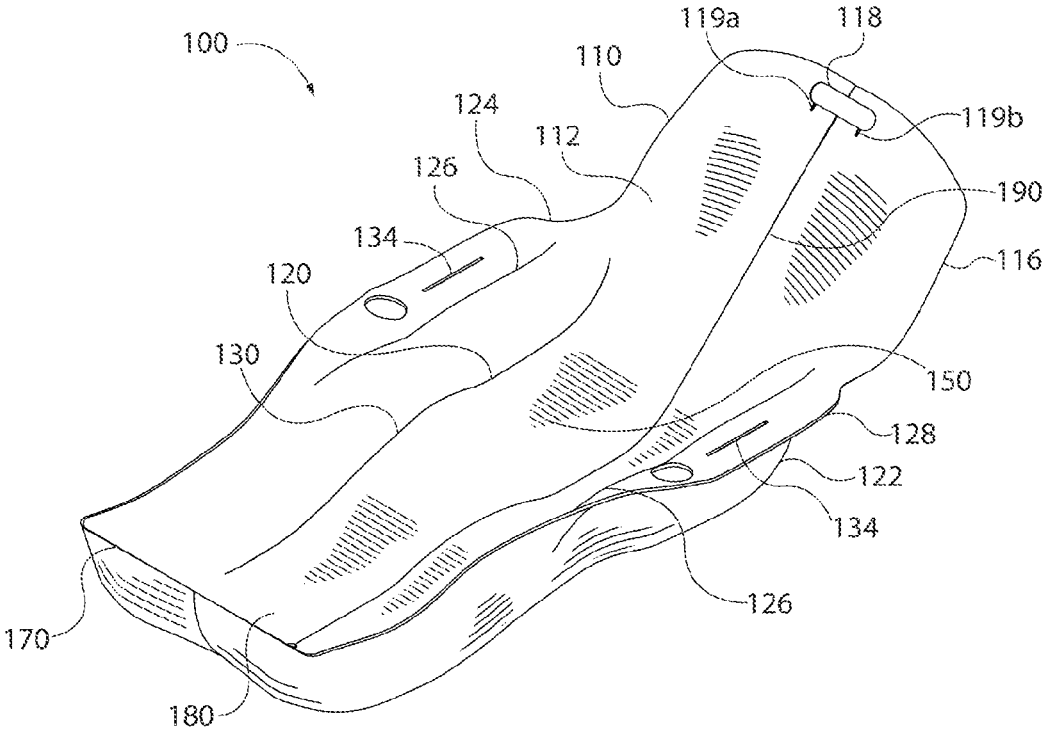
FIG. 1 shows a perspective view of a personal chair according to a first exemplary embodiment of the present invention.
Figure 2:
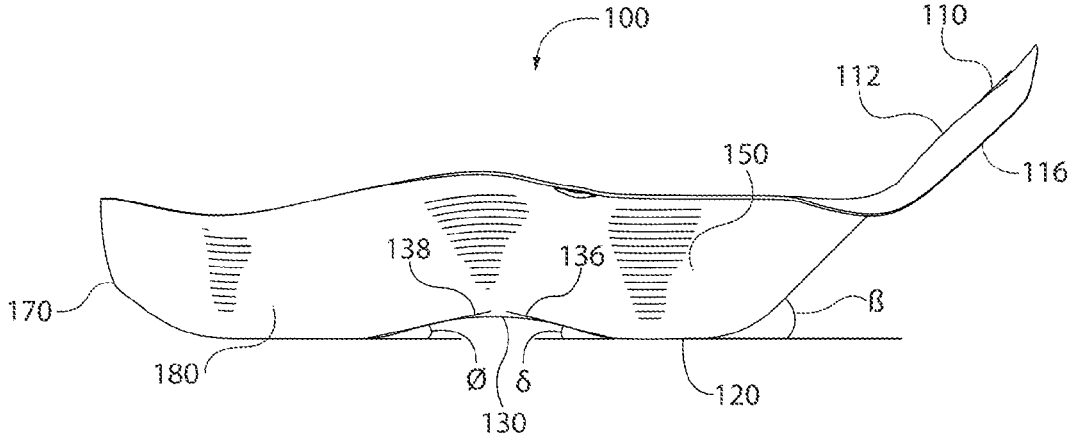
FIG. 2 shows a left side elevational view of the personal chair shown in FIG. 1, the right side elevational view being a mirror image thereof.
Figure 3:
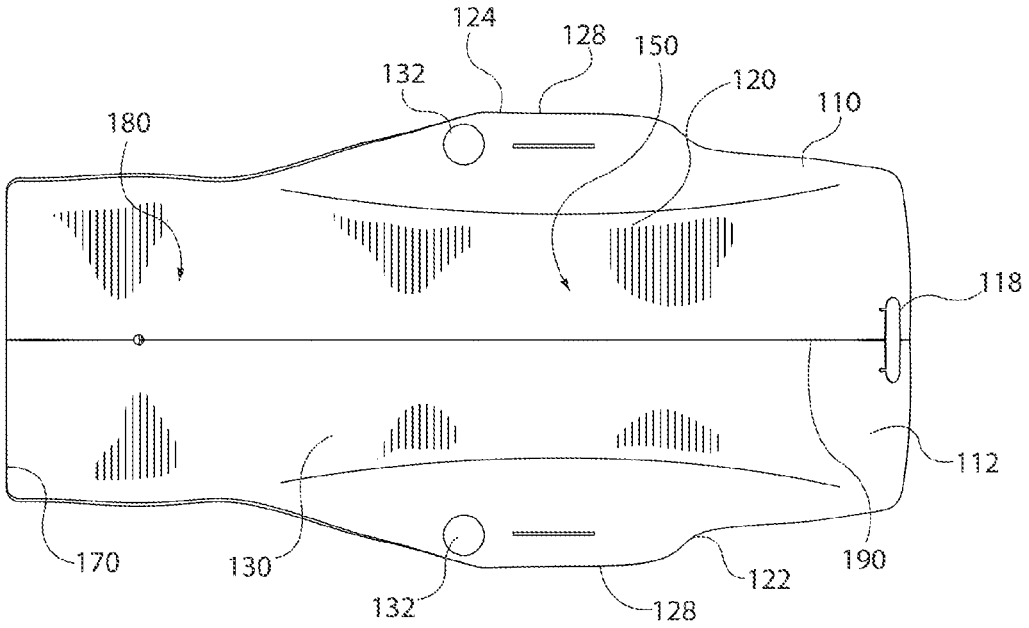
FIG. 3 is a top plan view of the personal chair shown in FIG. 1.
Figure 4:
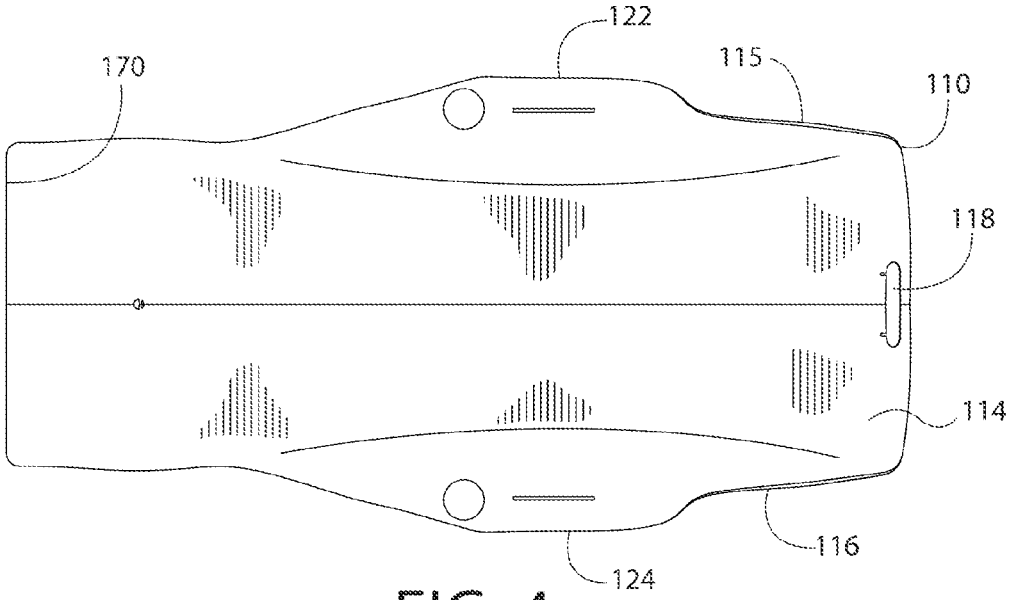
FIG. 4 is a bottom plan view of the personal chair shown in FIG. 1.
Figure 5:
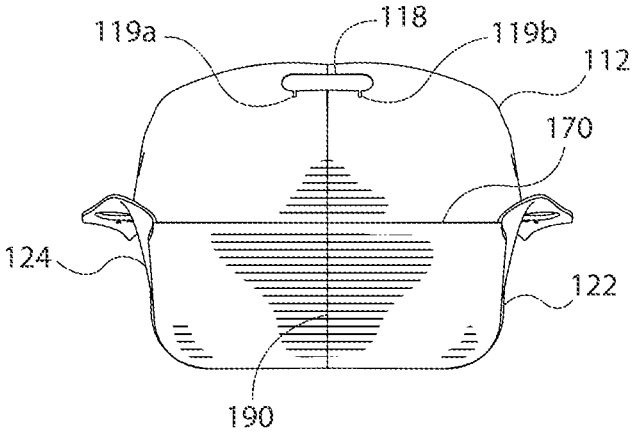
FIG. 5 is a front elevational view of the personal chair shown in FIG. 1.
Figure 6:
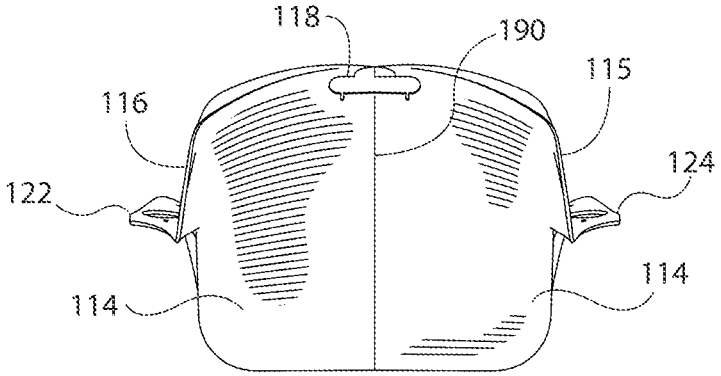
FIG. 6 is a rear elevational view of the personal chair shown in FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "longitudinal" means a direction along a line between a head portion and a foot portion of the inventive device and the term "lateral" means a direction along a line between the left side and the right side of the inventive device. Further, as used herein, the term "proximal" means a direction toward a head end of the inventive device and "distal" means a direction toward a foot end of the inventive device.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Although the subject matter described herein may be described in the context of illustrative implementations to process one or more computing application features/operations for a computing application having user-interactive components the subject matter is not limited to these particular embodiments. Rather, the techniques described herein can be applied to any suitable type of user-interactive component execution management methods, systems, platforms, and/or apparatus.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Referring to FIGS. 1-7, a personal chair 100 ("chair 100") according to an exemplary embodiment of the present invention is shown. Chair 100 is a single-person pool that can be used by a user to sit in a pool of liquid.

Chair 100 includes a proximal end 110, a seat portion 120, and a central, or knee, portion 130 that combine to form a first pool 150, and a foot portion 160 and distal end 170 that combine with knee portion 130 to form a second pool 180.

In an exemplary embodiment, a central longitudinal centerline 190 extends between proximal end 110 and distal end 170 such that chair 100 on one side of longitudinal centerline 190 is a mirror image of chair 100 on the other side of longitudinal centerline 190. In an exemplary embodiment, chair 100 can be constructed from a rigid polymer or some other suitable rigid material.

Proximal end 110 includes a front face 112 that is part of first pool 150 and on which a user's back (not shown) rests during use. In an exemplary embodiment, proximal end 110 extends at an angle β of between about 40 degrees and about 60 degrees and, in an alternative embodiment, between about 45 degrees and about 50 degrees, although those skilled in the art will recognize that angle β can be other values as well.

Proximal end 110 also includes a rear face 114 that opposes front face 112. Optionally, flanges 115, 116 extend from proximal end 110 away from front face 112 such that flanges 115, 116 provide support and stability for proximal end 110.

Proximal end 110 also includes a generally elongate slot 118 that extends generally horizontally through front face 112 and rear face 114 and is bisected by longitudinal centerline 190. Slot 118 is large enough to allow a user to insert four fingers therethrough to use slot 118 as a handgrip so that the user can grip chair 100 through slot 118 and move chair 100. Notches 119*a*, 119*b* extend downwardly from slot 118 and are used to releasably retain a headrest 240 that will be described in detail later herein.

Seat portion 120 has a generally concave shape that accepts and supports the user's posterior when the user is sitting in chair 100. Seat portion 120 includes a pair of sidewalls 122, 124 that extend on either side of longitudinal centerline 190. In an exemplary embodiment, sidewall 124 is a mirror image of sidewall 122, so only sidewall 122 will be discussed below, with the understanding that the same description applies to sidewall 124 as well. Sidewall 122 extends longitudinally between proximal end 110 and distal end 170 such that a liquid can be contained within chair 100 between proximal end 110, distal end 170, and sidewalls 122, 124.

Side wall 122 includes a top end 126 from which an armrest 128 extends laterally outwardly away from longitudinal centerline 190. Armrest 128 is also connected to flange 115. In an exemplary embodiment, armrest 128 includes an opening 132. Opening 132 is generally circular in shape and can be used to releasably retain a cup or other object.

Additionally, armrest 128 also includes a slot 134 extending therethrough. Slot 134 extends generally parallel to longitudinal centerline 190. Slot 134 is used to releasably accept and retain a tray 220.

Figure 7:
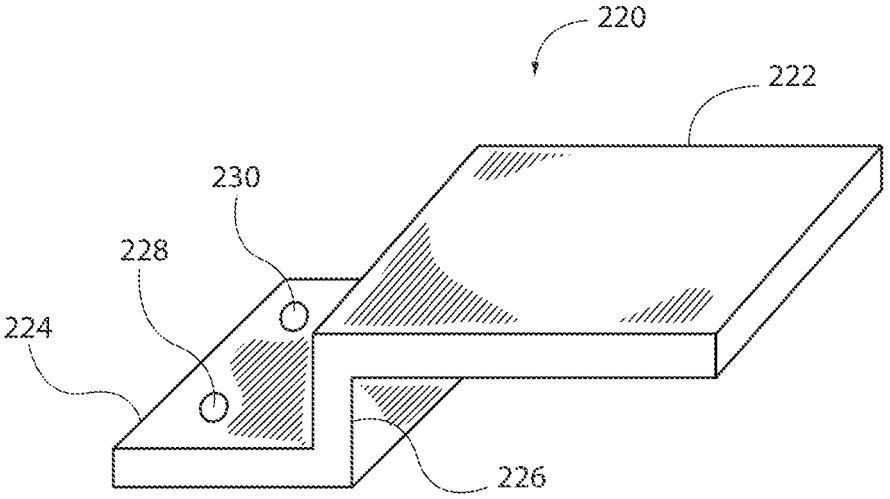
FIG. 7 is a perspective view of a removable tray for use with the personal chair shown in FIG. 1.

Referring to FIG. 7, tray 220 includes a first planar surface 222 that can be used as a tabletop. Tray 220 also includes a second planar surface 224 that extends generally parallel to first planar surface 222. Second planar surface 224 can be a tab that is insertable into slot 134. A connecting portion 226 connects first planar surface 222 to second planar surface 224. Openings 228, 230 are formed in second planar surface 224.

Figure 8:
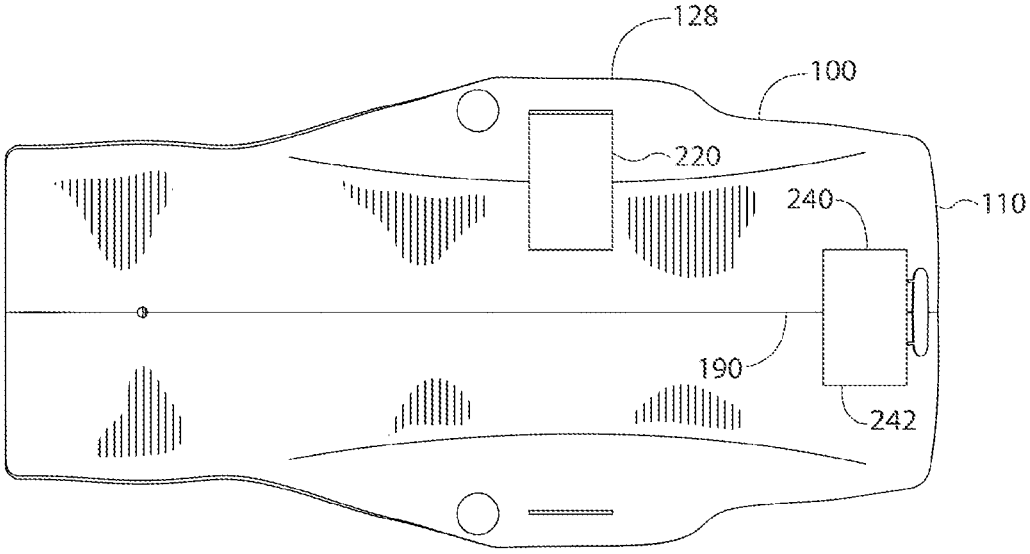
FIG. 8 is a top plan view of the personal chair shown in FIG. 1, with a removable tray attached to the chair and extending inwardly toward a longitudinal centerline of the chair.
Figure 9:
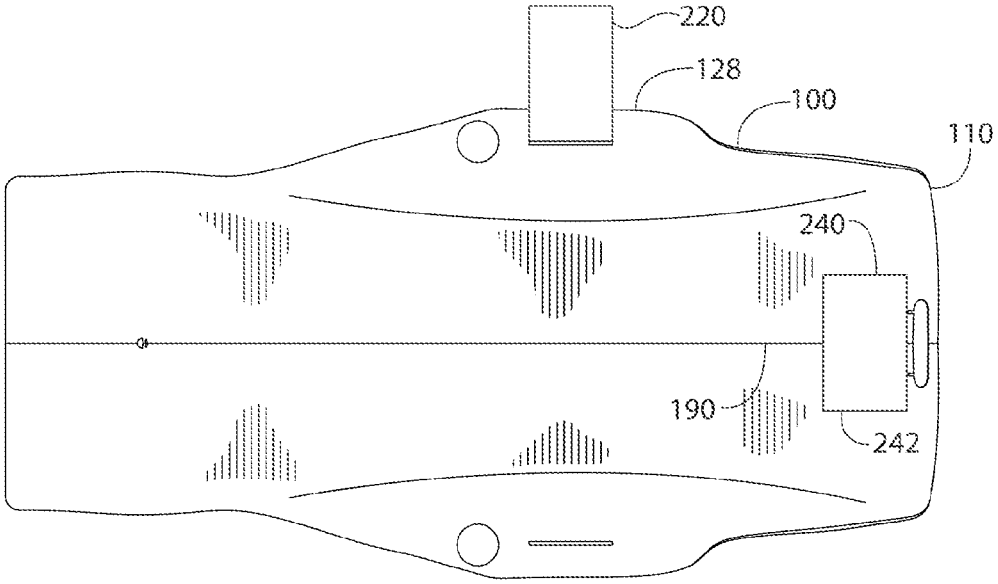
FIG. 9 is a top plan view of the personal chair shown in FIG. 1, with a removable tray attached to the chair and extending outwardly away from a longitudinal centerline of the chair.
Figure 11:
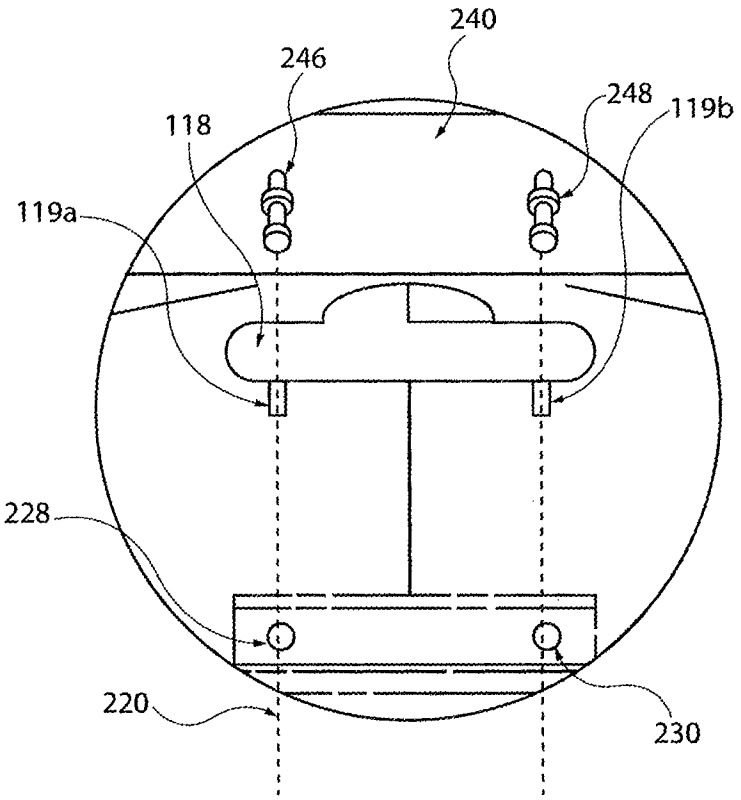
FIG. 11 is a side elevational view, in section, of the proximal end of the chair shown in FIG. 1, with the headrest of FIG. 10 and a removable tray of FIG. 7 attached thereto.

In use, tray 220 can extend laterally toward centerline 190, as shown in FIG. 8 or, alternatively, tray 220 can extend laterally away from centerline 190, as shown in FIG. 9. When not attached to armrest 128, tray 220 can be removably stored along rear face 114, as shown in FIG. 11.

Figure 10:
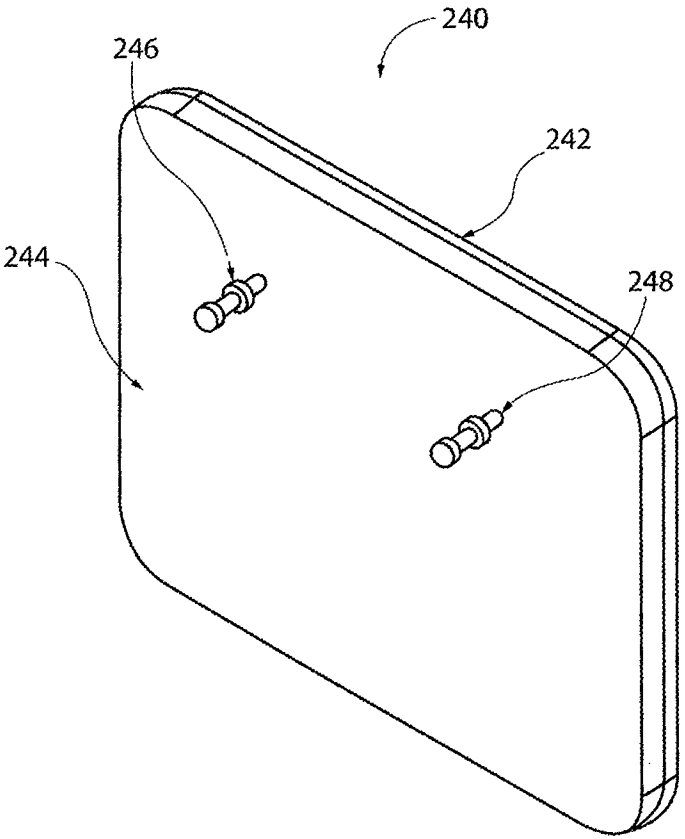
FIG. 10 is a rear perspective view of a headrest used with the chair shown in FIG. 1.

As shown in FIGS. 8-10, a headrest 240 is releasably connectable to front face 112. Headrest 240 includes a front face 242 against which a user leans his/her head. Headrest 240 also includes a rear face 244. Pegs 246, 248 extends outwardly from rear face 244. Pegs 246, 248 are spaced from each other sufficiently to extend into notches 119*a*, 119*b* in slot 118 in proximal end 110.

Additionally, pegs 246, 248 are spaced from each other sufficiently so that pegs 246, 248 can be inserted into openings 228, 230 on tray 220. As shown in FIG. 11, when headrest 240 is removably attached to front face 112, pegs 246, 248 extend through notches 119*a*, 119*b* and project outwardly from rear face 114. Tray 220 can be placed over pegs 246, 248 such that pegs 246, 248 extend into openings 228, 230, respectively, allowing tray 220 to be removably attached to chair 100 along rear face 114.

Optionally, flanges 115, 116 can include openings (not shown) that can accommodate a strap such as, for example, a bungee cord, to extend therebetween to bias tray 220 against rear face 114. Still optionally, instead of a strap, a storage container extending between flanges 115, 116 can be used to bias tray 220 against rear face 114.

Referring back to FIGS. 1 and 3, knee portion 130 extends upwardly from seat portion 120 and has a generally convex shape over which the user's thighs/calves extend. Knee portion 130 extends upwardly by a height less than the height of proximal portion 110. Knee portion 130 includes a proximal portion 136 that extends at an angle δ of between about 5 degrees and about 25 degrees and, in an alternative embodiment, between about 10 degrees and about 20 degrees, although those skilled in the art will recognize that angle δ can be other values as well. Knee portion 130 also includes a distal portion 138 that extends at an angle θ of between about 5 degrees and about 25 degrees and, in an alternative embodiment, between about 10 degrees and about 20 degrees, although those skilled in the art will recognize that angle θ can be other values as well.

Distal end 170 extends above knee portion 130 at the distal end of second pool 180, which can act as a foot rest. Sidewalls 122 extend between knee portion 130 and distal end 170, forming boundaries that define second pool 180.

Chair 100 is stackable on top of another chair 100 such that a plurality of chairs 100 can be stacked on each other, such as, for example, for storage and/or retail display.

An alternative embodiment of a pool 300 according to the present invention is shown in FIGS. 12-18. Pool 300 can be constructed from a rigid polymer or other suitable material. Pool 300 is sized for single-user and can be used as a meditation pool.

Figure 12:
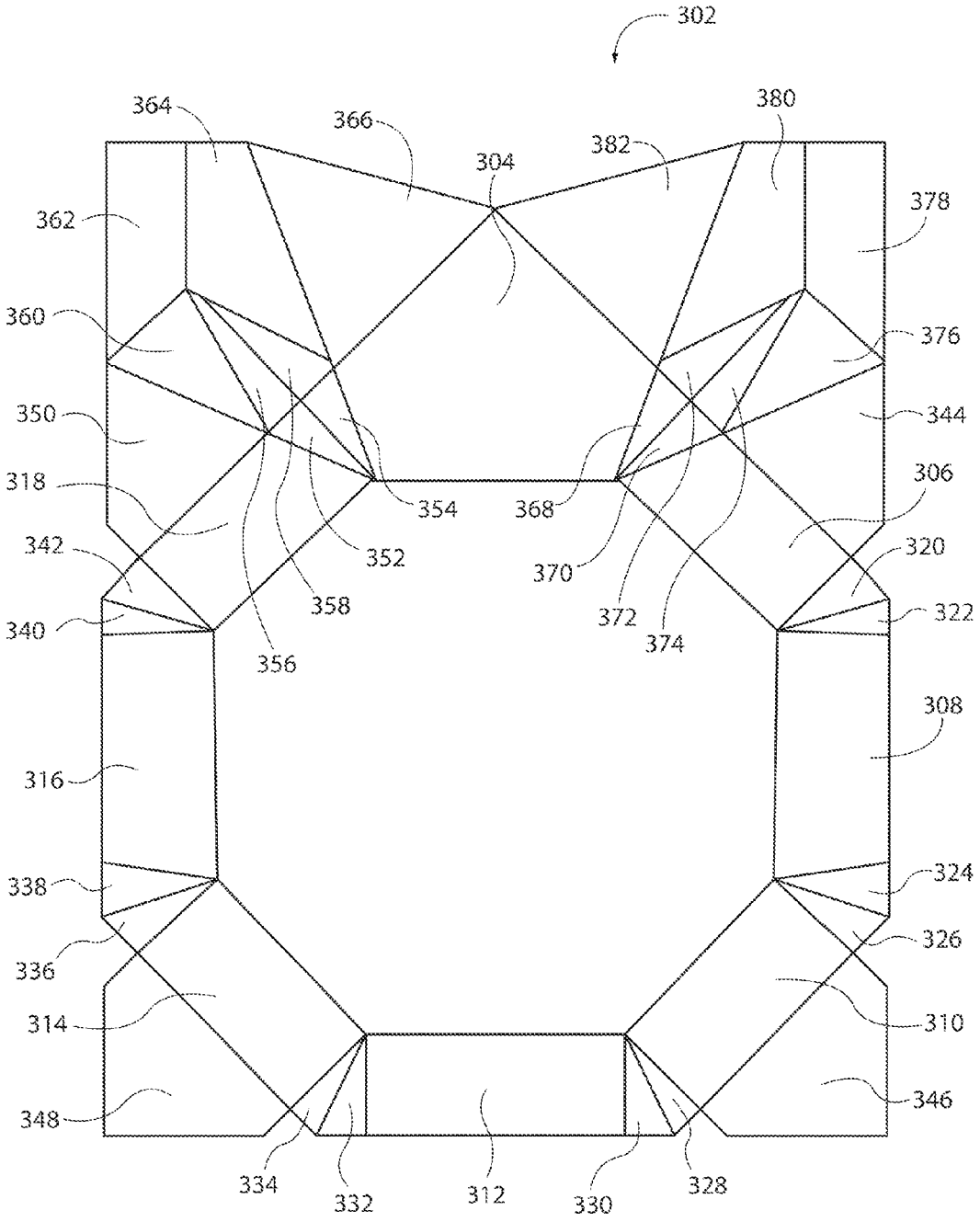
FIG. 12 is a top plan view of an individual pool according to a second exemplary embodiment of the present invention, with the pool in an unassembled condition.
Figure 13:
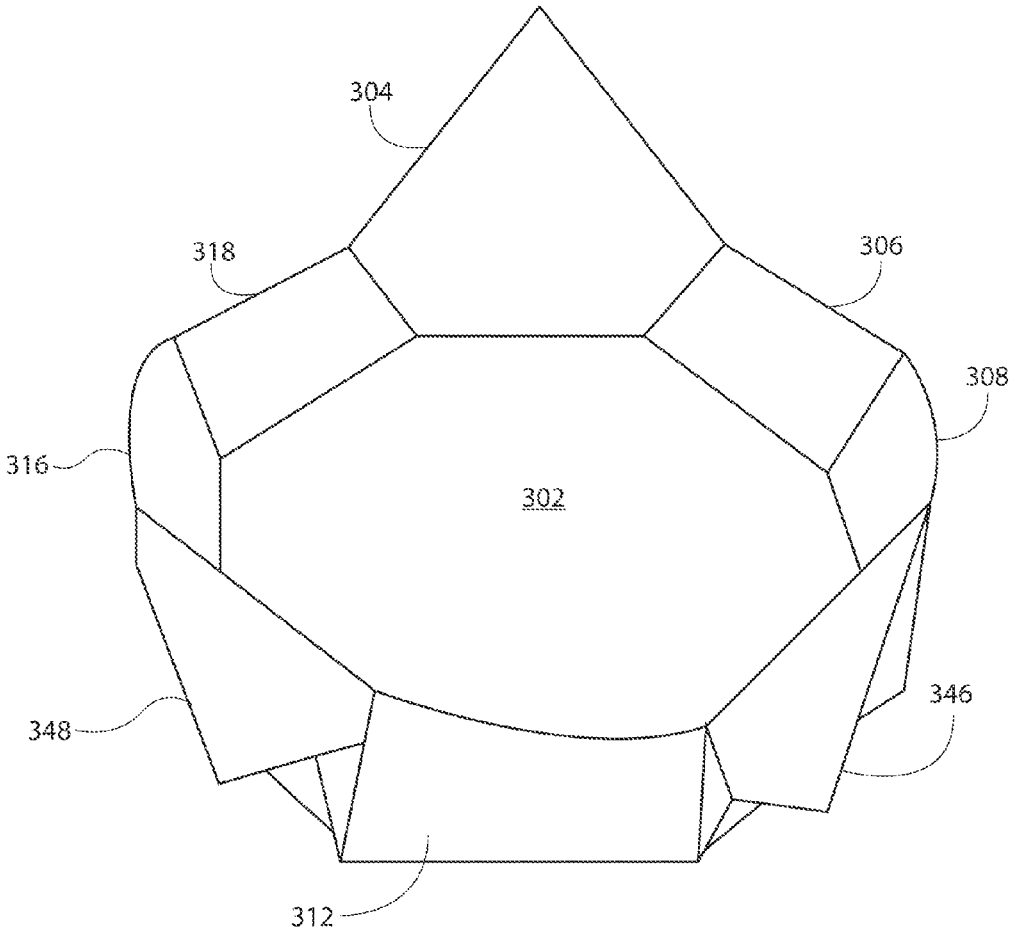
FIG. 13 is a front perspective view of the individual pool of FIG. 12 in an assembled condition.

As shown in FIG. 12, in one configuration, pool 300 is a generally planar sheet that includes a plurality of polygons 302-382 defined by score lines such that generally planar sheet can be folded along the score lines in a first configuration, forming pool 300 as shown in FIGS. 13-18. Alternatively, polygons 302-382 can be folded along the score lines in a second configuration, such that pool 300 is configured for storage and/or travel Polygon 302 is generally octagonal in shape and is used as a base or a seat 302. A polygon 304 is connected to seat 302 and is generally pentagonal in shape. Polygon 304 can be used as a rear wall against which the user can rest.

Polygons 306-318 are connected to seat 302, and are generally quadrilateral in shape. Polygons 306-318 are used as sidewalls of chair 300 such that polygons 304-318 form sidewalls 304-318 that retain fluid, such as, water, within chair 300.

A pair of adjacent triangular sidewalls 320, 322 extend between sidewall 306 and sidewall 308. Similarly, a pair of adjacent triangular sidewalls 324, 326 extend between sidewall 308 and sidewall 310; a pair of adjacent triangular sidewalls 328, 330 extend between sidewall 310 and sidewall 312; a pair of adjacent triangular sidewalls 332, 334 extend between sidewall 312 and sidewall 314; a pair of adjacent triangular sidewalls 336, 338 extend between sidewall 314 and sidewall 316; and a pair of adjacent triangular sidewalls 340, 342 extend between sidewall 316 and sidewall 318.

A locking wall 344 extends outwardly from sidewall 306, away from seat 302. Similarly, a locking wall 346 extends outwardly from sidewall 310, away from seat 302; a locking wall 348 extends outwardly from sidewall 314, away from seat 302; and a locking wall 350 extends outwardly from sidewall 318, away from seat 302. In an exemplary embodiment, each of locking wall 344-350 can be pentagonal in shape, although those skilled in the art will recognize that locking walls 344-350 can be other shapes as well.

Walls 352-354 and panels 356-366 connect rear wall 304 with sidewall 318, and also support rear wall 304 and sidewall 318 when forming pool 300. Generally triangular and adjacent sidewalls 352 and 354 extend between rear wall 304 and sidewall 318. Similarly, walls 368-370 and panels 372-382 connect rear wall 304 with sidewall 306, and also support rear wall 304 and sidewall 306 when forming pool 300. A zipper assembly 384 connects a side of panel 366 with a side of panel 382 so that panels 366 and 382 are behind and support rear wall 304 when forming pool 300.

A method of folding walls 304-382 to form pool 300, as shown in FIGS. 13-18 will now be described. Those skilled in the art will recognize that the steps that are described herein may not necessarily be performed in the order recited. As used herein, the term "outward" means away from seat 302, such that, when pool 300 is formed, any wall or panel that has been folded outward is outside of the inner perimeter of pool 300.

From the planar configuration shown in FIG. 12, rear wall 304 is folded upward at the boundary between rear wall 304 and seat 302, forming an angle of about 90° between rear wall 304 and seat 302. Similarly, sidewalls 306-318 are also folded upward at the boundary between each of sidewalls 306-318 and seat 302, forming an angle of about 90° between each of sidewalls 306-318 and seat 302.

As sidewalls 306-318 are folded upward, triangular sidewalls 320-342, 352, 354, 368, and 370 are folded our away from seat 302, such that rear wall 304 engages adjacent sidewalls 306 and 318, and each sidewall 306-318 engages its adjacent sidewalls 308-316. Triangular sidewalls 324, 326, 328, 330 are folded behind sidewall 310 and locking wall 346 is folded downward, away from seat 302, such that triangular sidewalls 324, 326, 328, 330 are disposed between sidewall 310 and locking wall 346. Similarly, triangular sidewalls 332, 334, 336, 338 are folded behind sidewall 314 and locking wall 348 is folded downward, away from seat 302, such that triangular sidewalls 332, 334, 336, 338 are disposed between sidewall 314, and locking wall 348.

Triangular sidewalls 368, 370 are folded against each other outwardly from seat 302, as are triangular panels, 372, 374, in a crimp fold. Panel 378 is folded outward, behind panels 376 and 380. Panels 344 and 382 are also folded outward, behind sidewall 306 and rear wall 304, respectively. Similarly, triangular sidewalls 352, 354 are folded against each other outwardly from seat 302, as are triangular panels 356, 358, in a crimp fold. Panel 362 is folded outward, behind panels 360 and 364. Panels 350 and 366 are also folded outward, behind sidewall 318 and rear wall 304, respectively.

Figure 14:
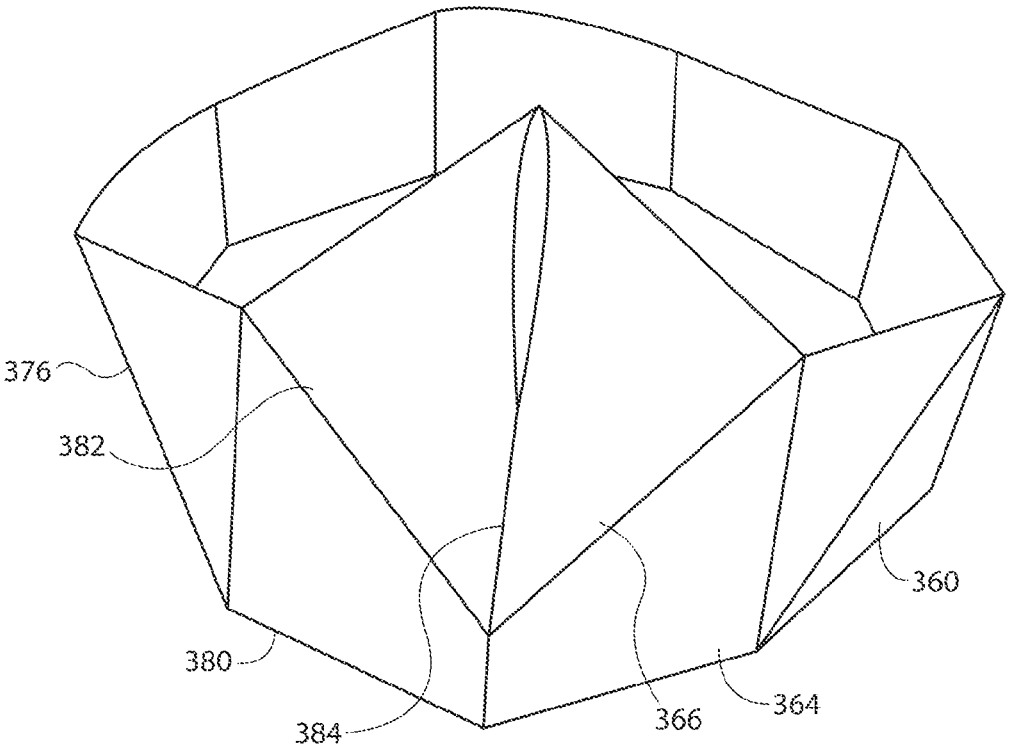
FIG. 14 is a rear perspective view of the individual pool shown in FIG. 13.
Figure 15:
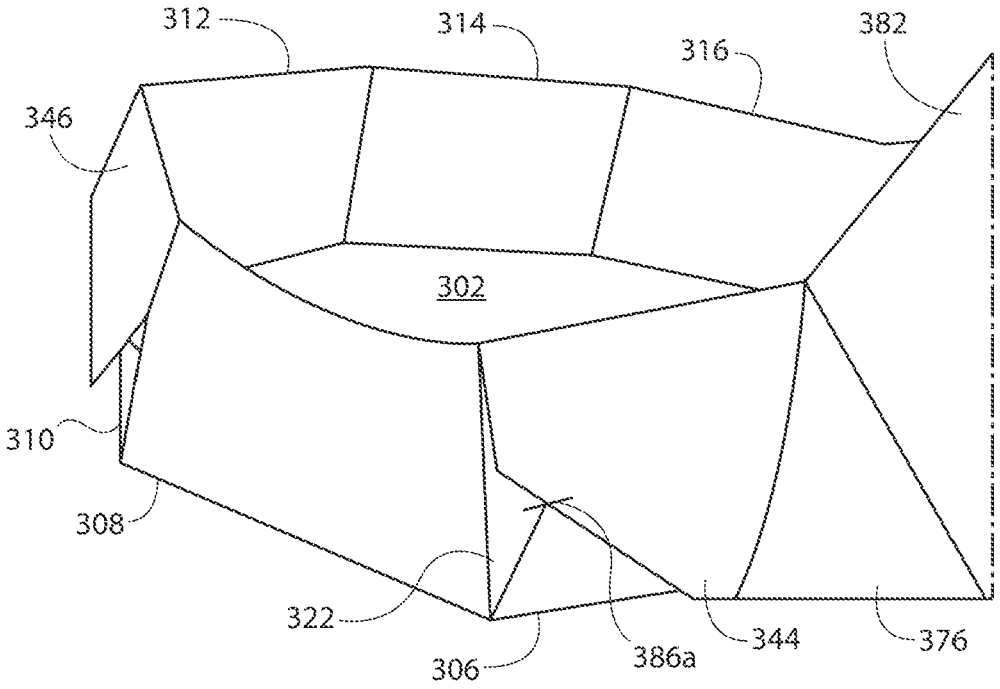
FIG. 15 is a left side perspective view of the individual pool shown in FIG. 13.
Figure 16:
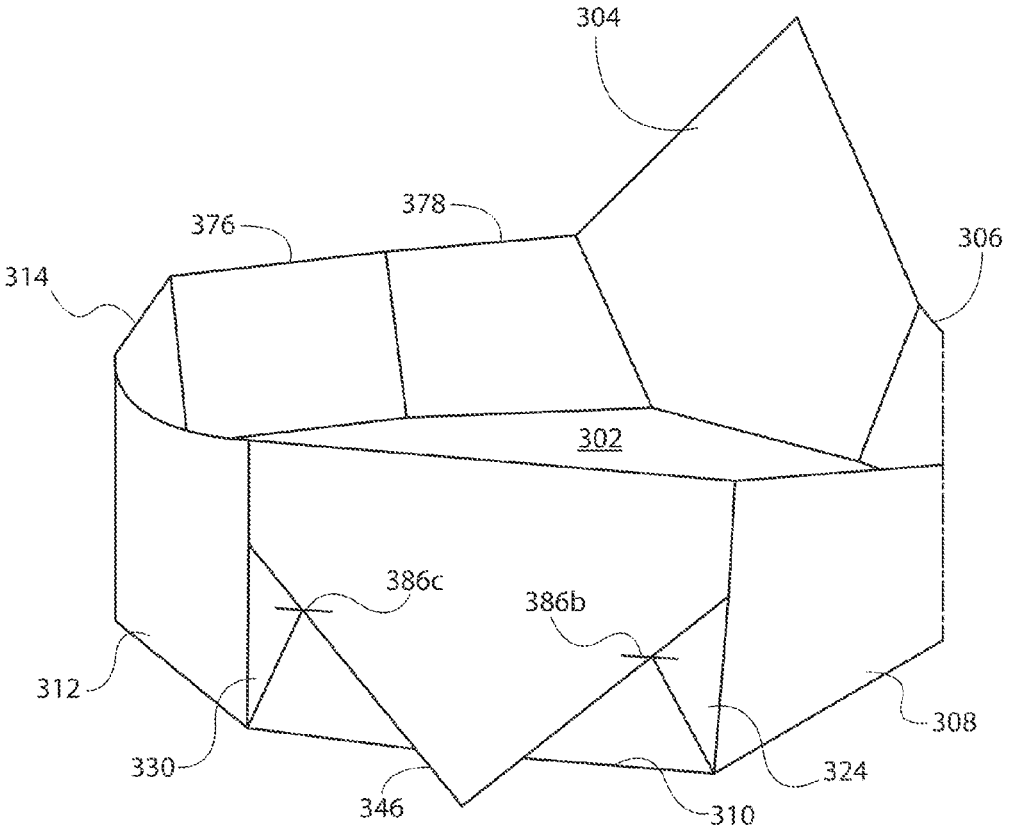
FIG. 16 is a lower front perspective view of the individual pool shown in FIG. 13.
Figure 17:
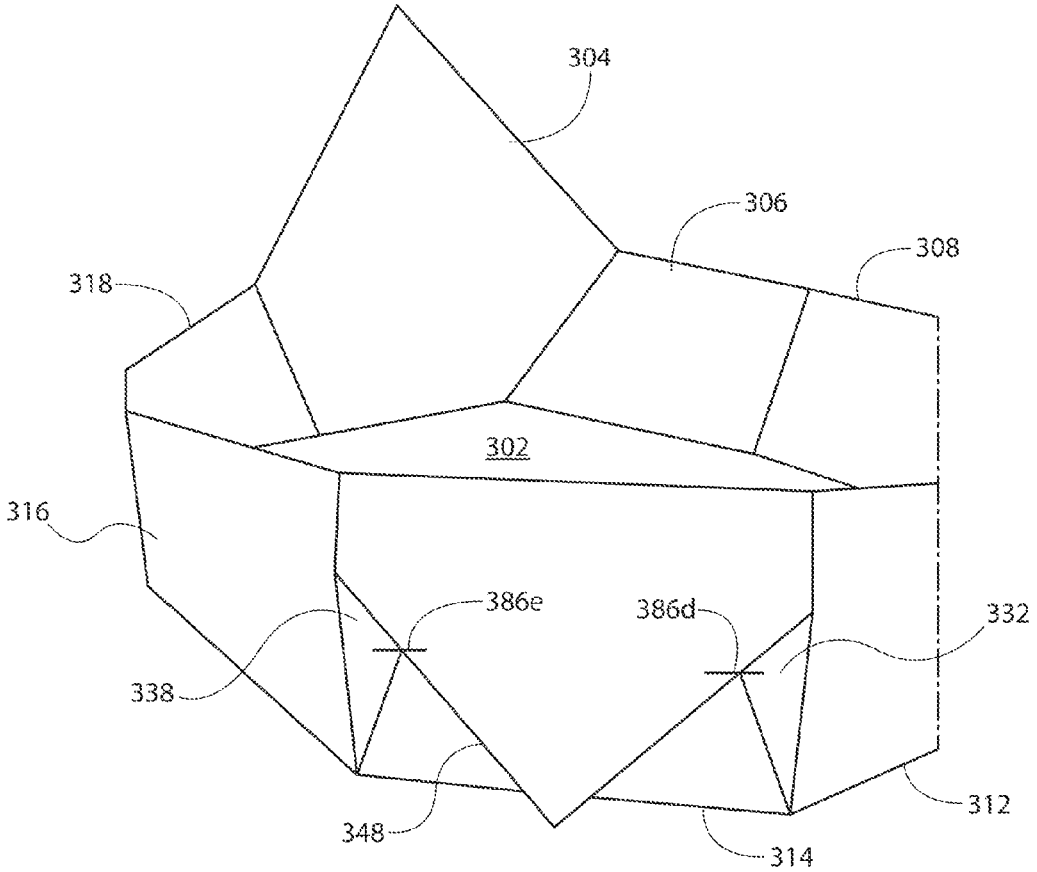
FIG. 17 is a front right perspective view of the individual pool shown in FIG. 13.
Figure 18:
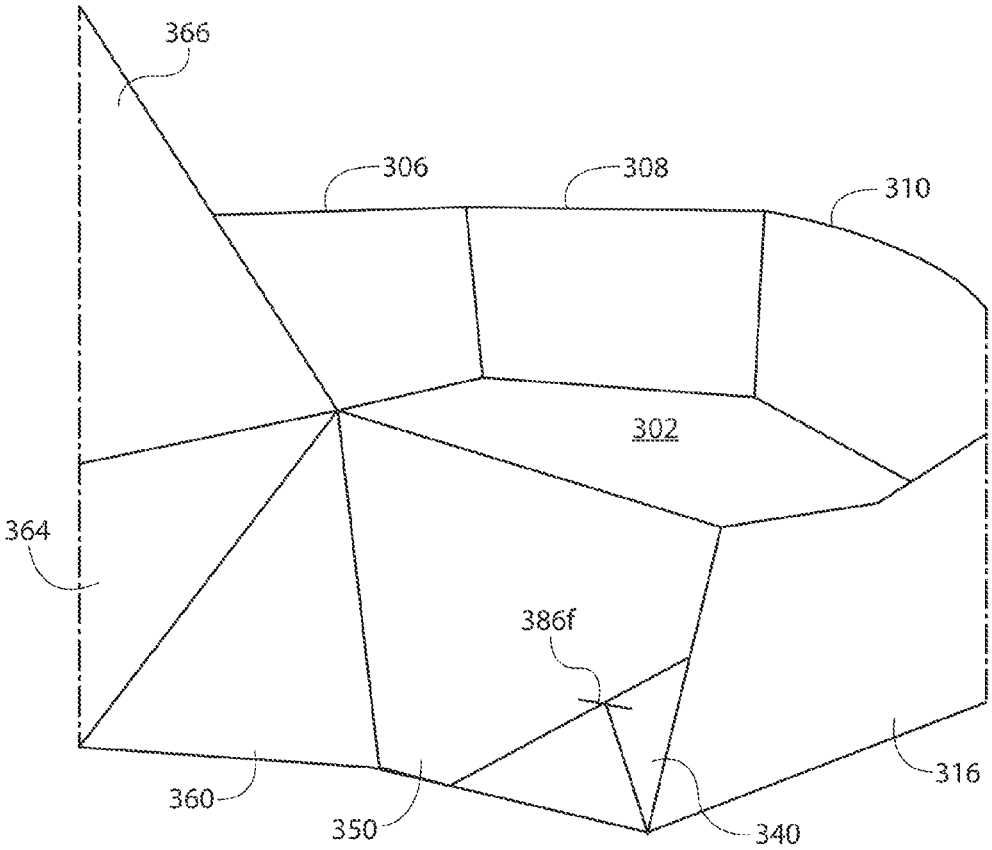
FIG. 18 is a rear right perspective view of the individual pool shown in FIG. 13.

Referring to FIG. 14, zipper assembly 384 is engaged to secure a side of panel 366 with an adjacent side of panel 382. Further, as shown in FIGS. 15-18, to secure sidewalls 306-318 in order to maintain the shape of pool 300, connectors 386 can be used at predetermined locations. In an exemplary embodiment, six connectors 386*a-f* are used around the perimeter of pool, 300. For example, as shown FIG. 15, a first connector 386*a* releasably connects panel 344 and triangular sidewall 322; as shown FIG. 16, a second connector 386*b* releasably connects locking wall 346 and triangular sidewall 324 and a third connector 386*c* releasably connects locking wall 346 and triangular sidewall 330; as shown FIG. 17, a fourth connector 386*d* releasably connects locking wall 348 and triangular sidewall 332 and a fifth connector 386*e* releasably connects locking wall 348 and triangular sidewall 338; and, as shown FIG. 18, a sixth connector 386*f* releasably connects locking wall 350 and triangular sidewall 340.

When it is desired to transport pool 300, pool 300 can be folded in a different configuration to form a generally compact, flat package that is convenient for transport. FIGS. 19-29, illustrate an exemplary method for folding pool 300 for transport.

Figure 19:
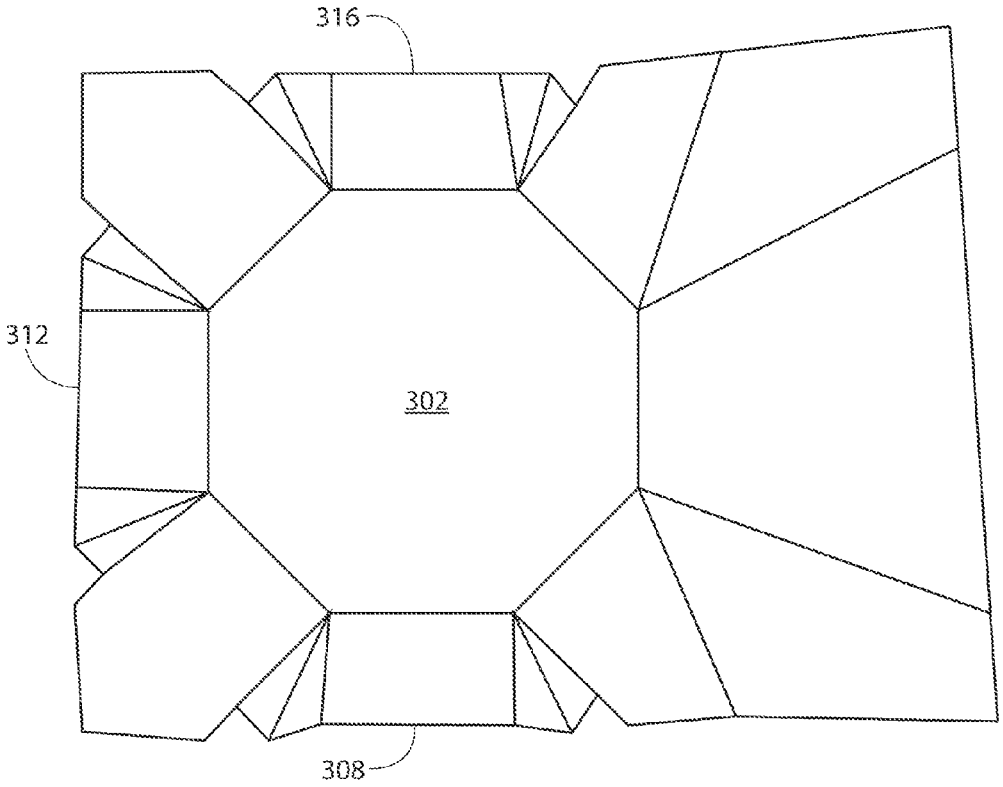
FIGS. 19-29 illustrate exemplary steps for folding the pool of FIG. 12 for transport.
Figure 20:
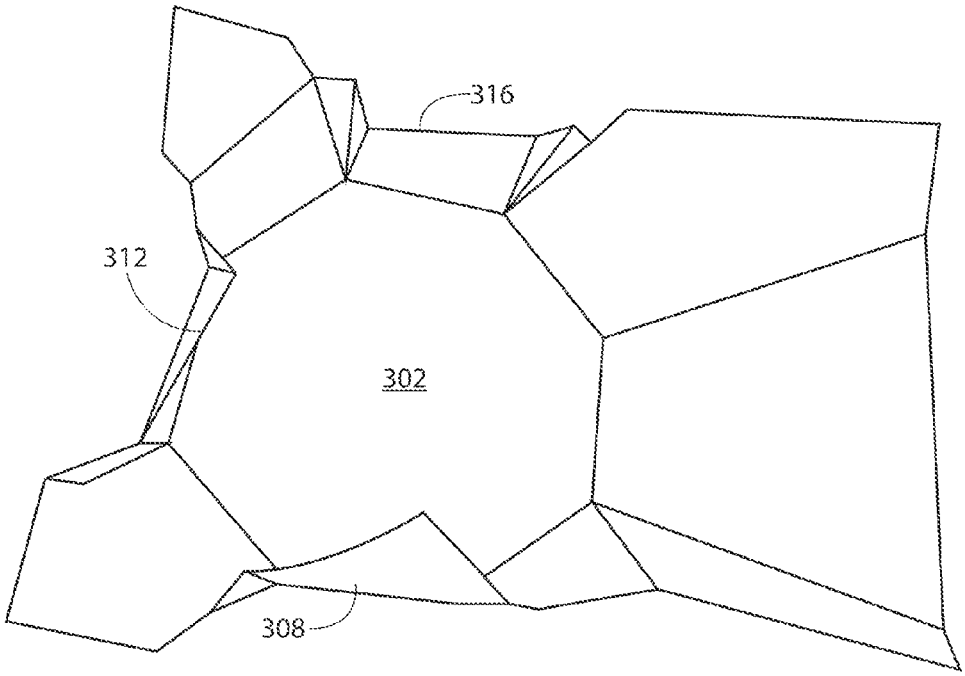
Figure 21:
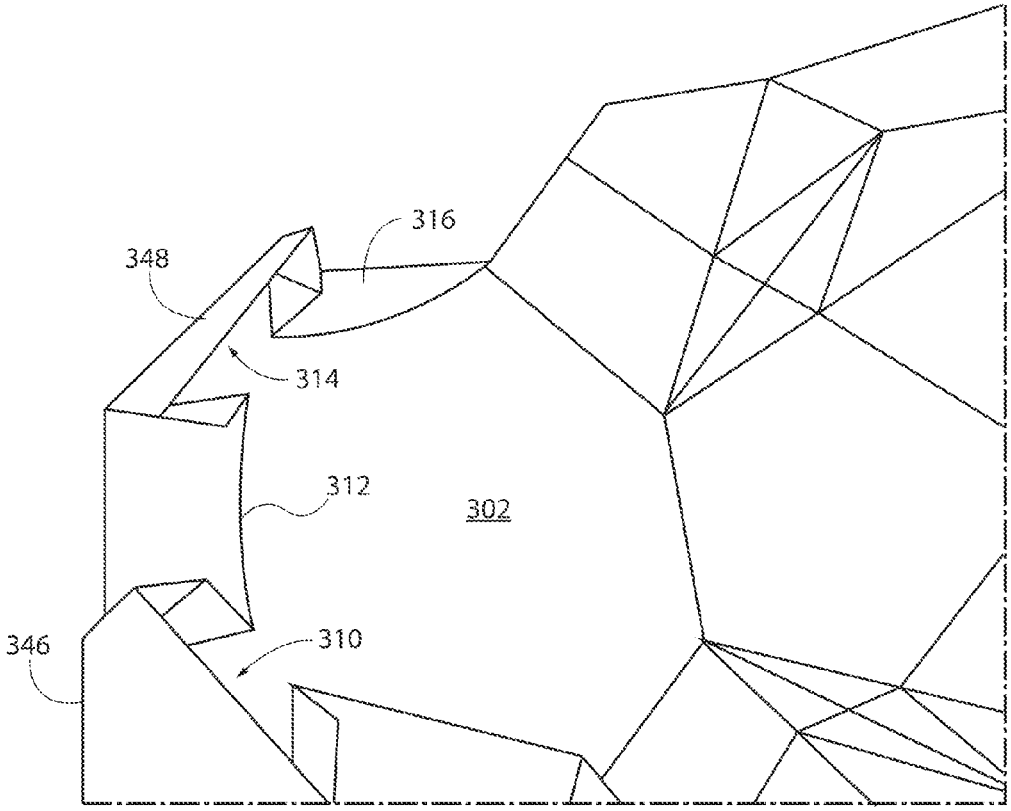
Figure 22:
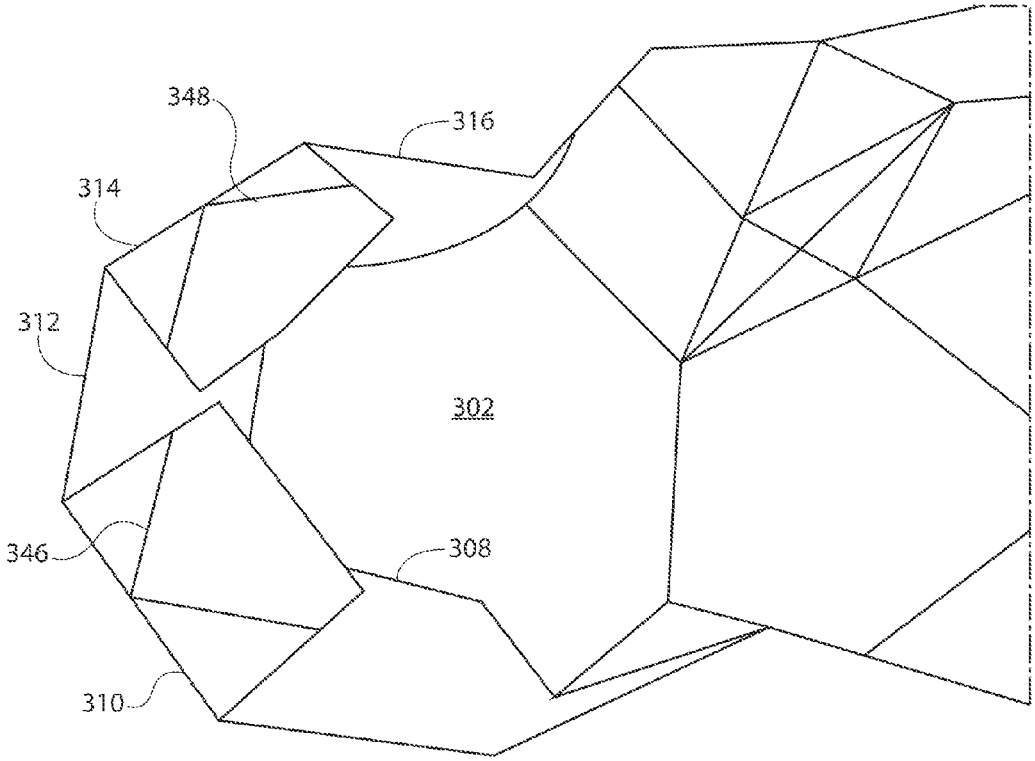

As shown in FIGS. 19 and 20, sidewalls 308, 312, 316 are folded inward toward seat 302. As shown in FIG. 21, locking walls 346, 348 are folded outward against their respective sidewalls 310, 314. As shown in FIG. 22, sidewalls 310, 314, with their respective locking wall 346, 348, are folded inward toward seat 302.

Figure 23:
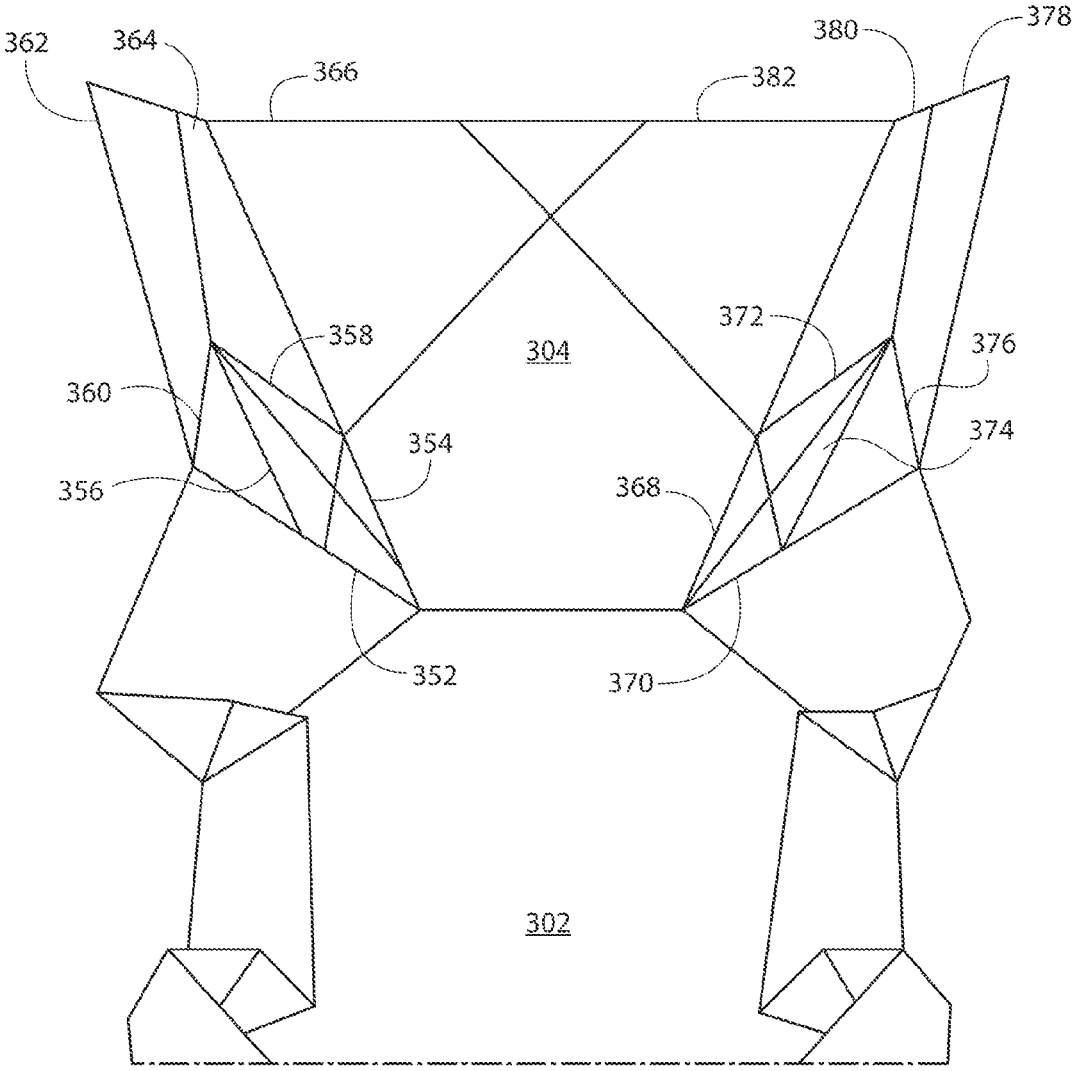
Figure 24:
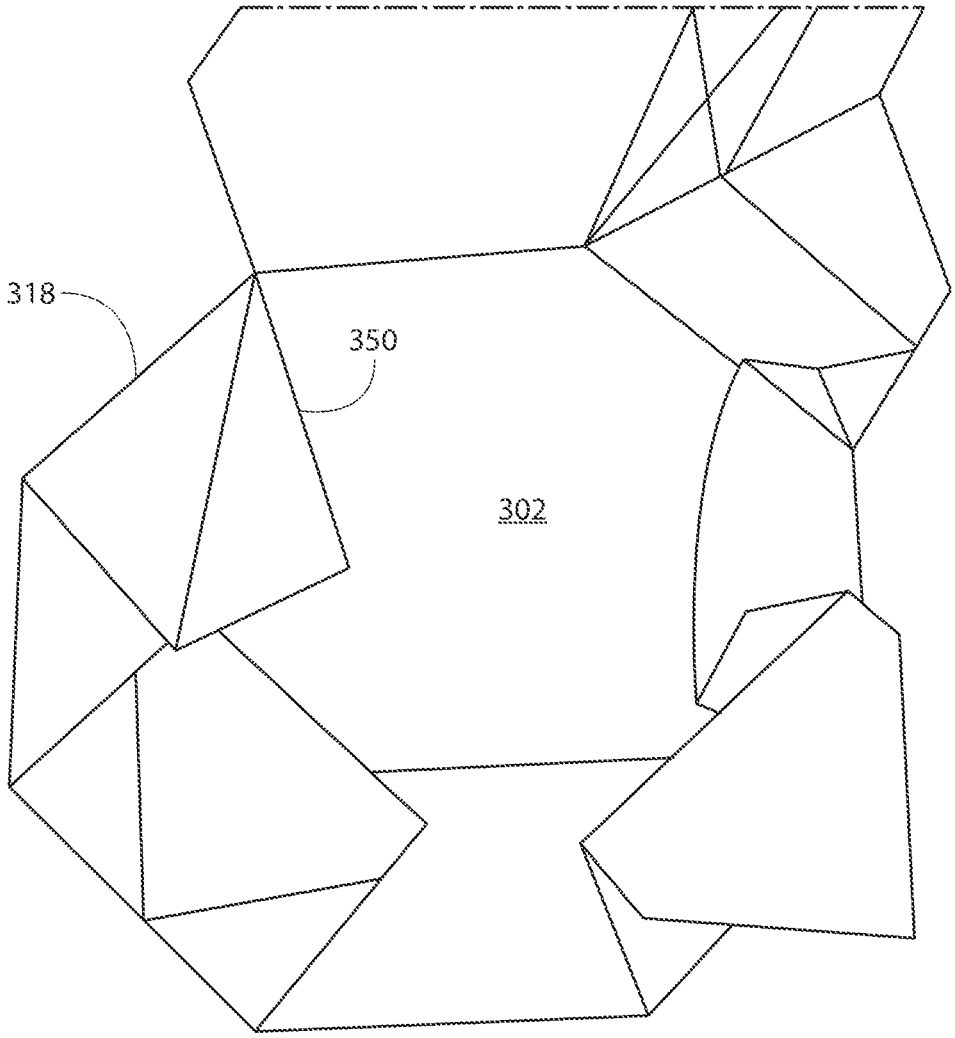
Figure 25:
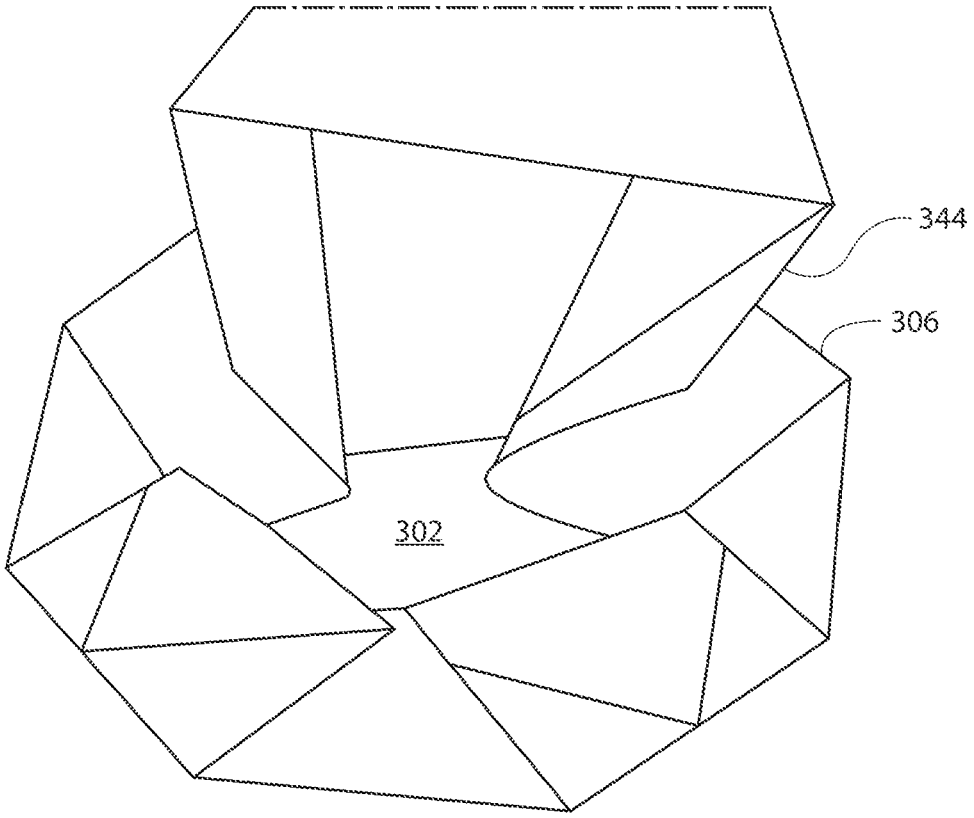
Figure 26:
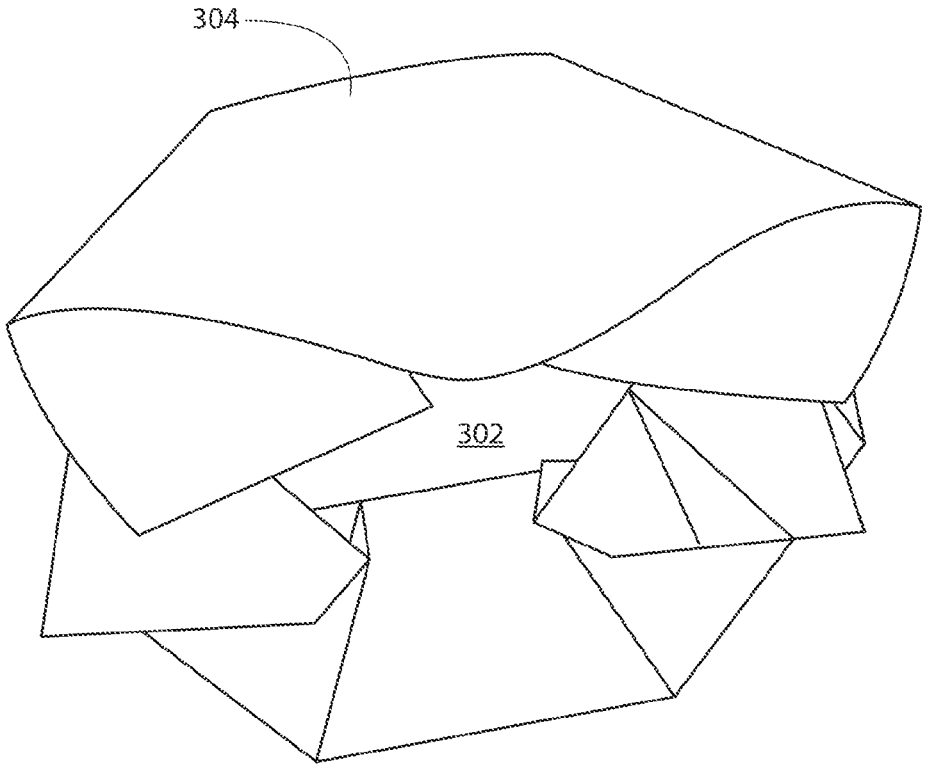
Figure 27:
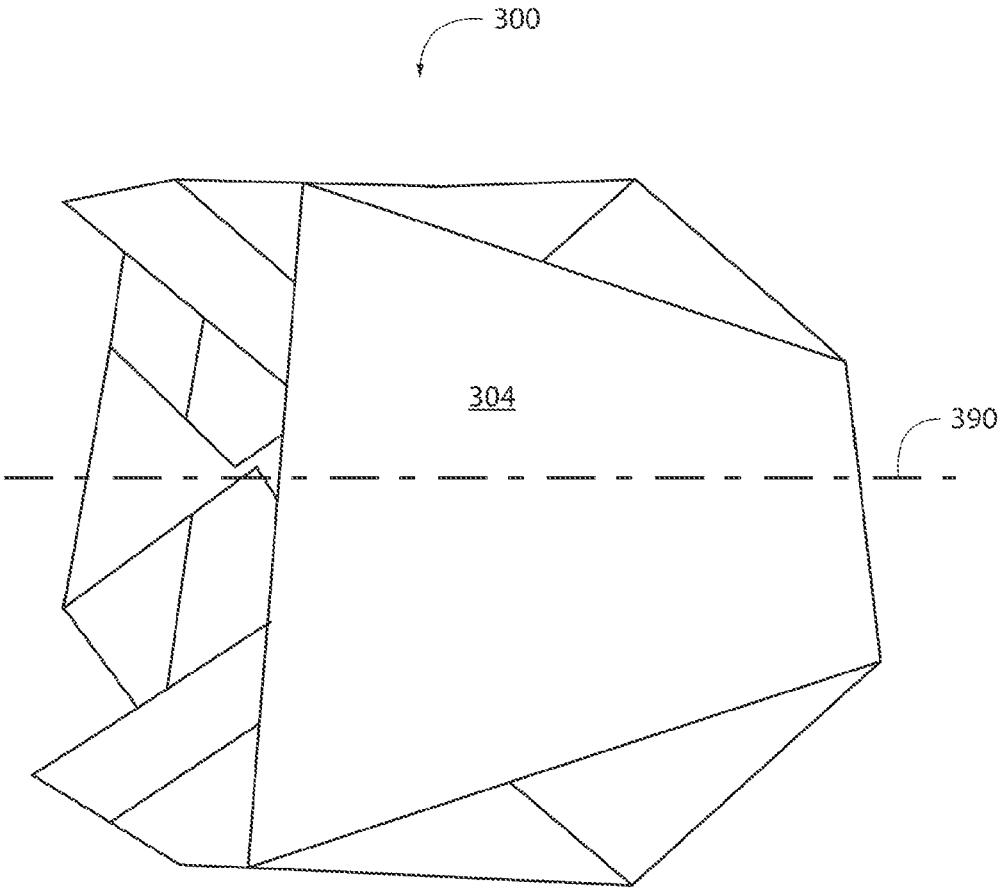

As shown in FIG. 23, panels 352-364 and panels 368-380 are folded inwardly toward rear wall 304. As shown in FIGS. 24 and 25, sidewalls 306 and 318 are folded inwardly toward seat 302. As shown in FIGS. 26 and 27, rear wall 304 is folded inwardly toward seat 302.

Figure 28:
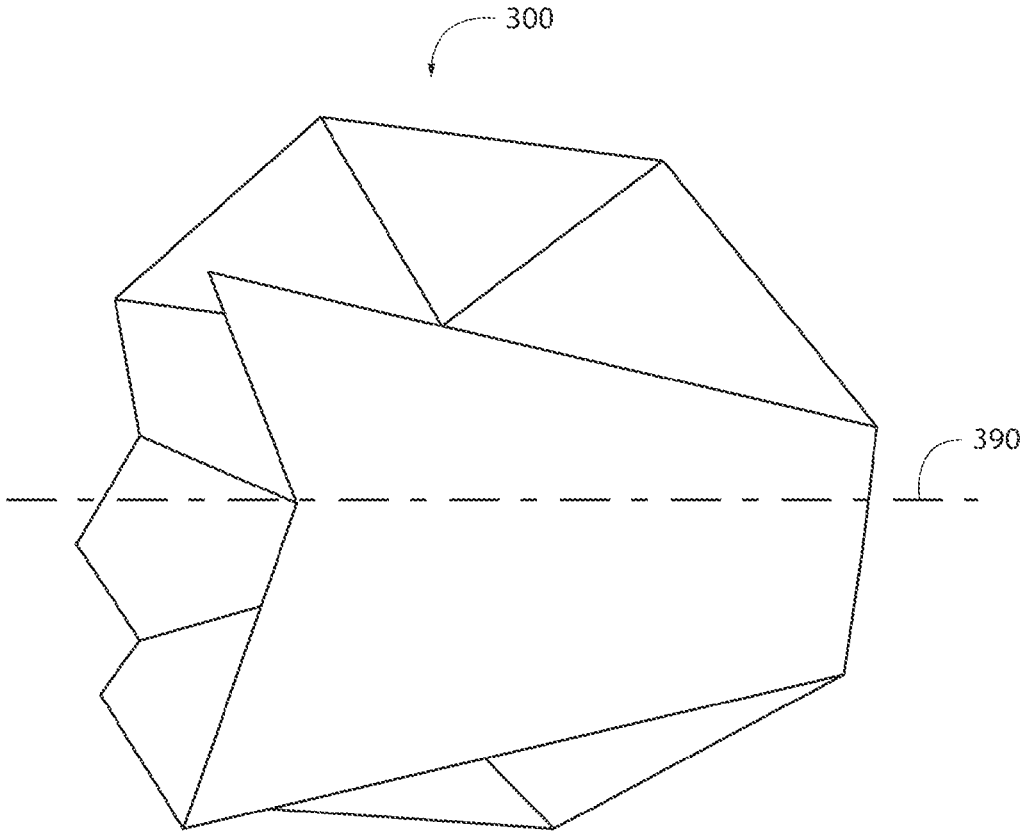
Figure 29:
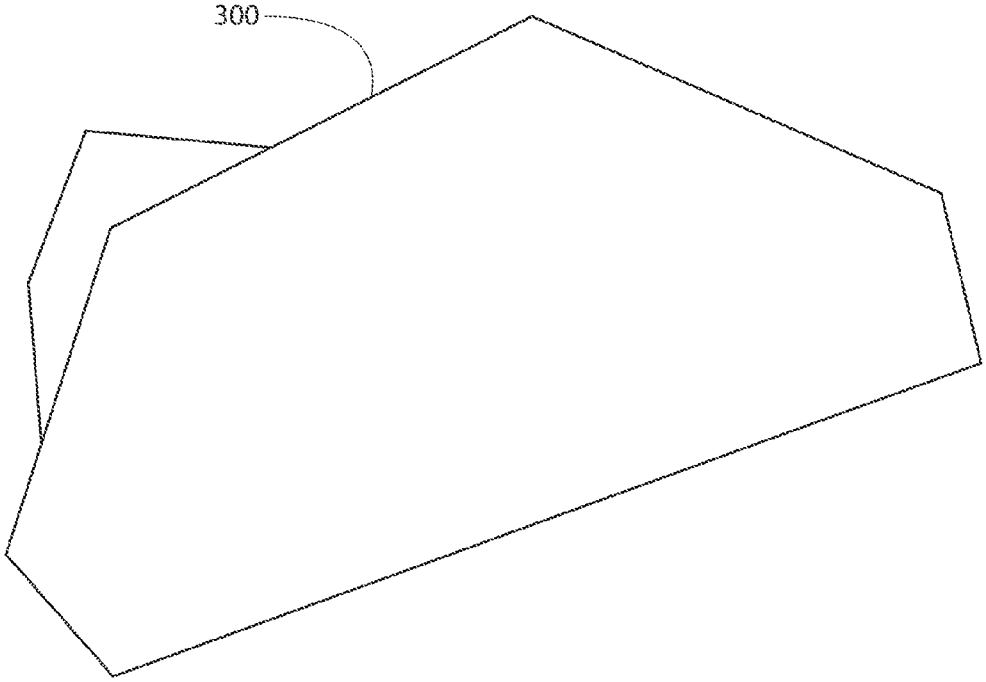

Optionally, to further compress pool 300, as shown in FIGS. 28 and 29, pool 300 can be folded in half across a central axis 390 (shown in FIG. 27). With pool 300 folded, pool 300 is available for transport.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. A single-person chair comprising:

a proximal end;

a distal end;

a generally convex central portion extending between the proximal end and the distal end, the central portion extending upwardly, forming a first pool between the proximal end and the central portion and a second pool between the distal end and the central portion;

a headrest releasably connectable to the proximal end;

a tray releasably connectable through the proximal end to the headrest;

a longitudinal centerline extending between the proximal end and the distal end;

a first sidewall extending between the proximal end and the distal end on a first side of the longitudinal centerline; and a second sidewall extending between the proximal end and the distal end on a second side of the longitudinal centerline, such that that a liquid can be contained within the chair between the proximal end, the distal end, the first sidewall, and the second sidewall.

2. The single-person chair according to claim 1, wherein each sidewall comprises an armrest extending outwardly from the respective sidewall, away from the longitudinal centerline.

3. The single-person chair according to claim 2, wherein each armrest comprises a slot formed therethrough, each slot extending generally parallel to the longitudinal axis.

4. The single-person chair according to claim 3, wherein said tray is releasably connectable to one of the armrests.

5. The single-person chair according to claim 4, wherein the tray comprises a tab insertable into the slot such, when the tab is inserted into the slot, the armrest supports the tray.

6. The single-person chair according to claim 4, wherein the tray is releasably connectable to the one of the armrests such that the tray is able to alternatively extend toward the longitudinal centerline and away from the longitudinal centerline.

7. A single-person chair assembly comprising:

a chair having at least one armrest and a backrest, the backrest having a front face and a rear face;

a tray alternatively releasably connectable to the at least one armrest and releasably attachable to the rear face a headrest releasably attachable to the front face, wherein the headrest comprises at least one peg extendable through the backrest to the rear face, wherein the tray is connectable to the at least one peg.

8. The single-person chair assembly according to claim 7, wherein the chair comprises a central longitudinal centerline and wherein, when the tray is connected to the at least one armrest, the tray alternatively extends toward the longitudinal centerline and away from the longitudinal centerline.

9. The single-person chair assembly according to claim 7, further comprising a distal end extending distally of the at least one armrest and a knee portion disposed between the distal end and the backrest.

10. The single-person chair assembly according to claim 9, further comprising a first generally concave pool defined between the backrest and the knee portion.

11. The single-person chair assembly according to claim 10, further comprising a second generally concave pool defined between the knee portion and the distal end.

12. The single-person chair assembly according to claim 7, wherein the tray comprises a first planar portion and a second planar portion, extending generally parallel to the first planar portion, wherein a connecting portion connects the first planar portion to the second planar portion.

13. The single-person chair assembly according to claim 12, wherein the second planar portion is insertable into the at least one armrest.

14. The single-person chair assembly according to claim 7, further comprising a sidewall connecting the at least one armrest and the backrest.

15. A single-person chair assembly comprising:

a first concave liquid retaining portion including a backrest having a front face and a rear face, a first sidewall extending from the backrest and a second sidewall extending from the backrest;

a second concave liquid retaining portion including a foot rest, the first sidewall connected to the foot rest, and the second sidewall connected to the foot rest;

a first armrest extending outwardly from the first sidewall and a second armrest extending outwardly from the second sidewall, each of the first armrest and the second armrest including a tray slot formed therein;

a headrest connected to the front face of the backrest, wherein the headrest comprises a peg extending outwardly from the rear face of the backrest;

a tray alternatively releasably insertable into one of the tray slots in the first armrest and the second armrest and releasably connectable to the peg.

* * * * *